United States Patent [19]

Mayes

[11] 4,443,802

[45] Apr. 17, 1984

[54] STRIPLINE FED HYBRID SLOT ANTENNA

[75] Inventor: Paul E. Mayes, Champaign, Ill.

[73] Assignee: University of Illinois Foundation, Urbana, Ill.

[21] Appl. No.: 256,424

[22] Filed: Apr. 22, 1981

[51] Int. Cl.[3] ..... H01Q 13/18

[52] U.S. Cl. ..... 343/729; 343/767; 343/770

[58] Field of Search ..... 343/700 MS, 767, 768, 343/769, 770, 725, 729

[56] References Cited

U.S. PATENT DOCUMENTS

| | | | |
|---|---|---|---|
| 3,665,480 | 5/1972 | Fassett | 343/700 MS |
| 4,130,822 | 12/1978 | Conroy | 343/767 |
| 4,197,545 | 4/1980 | Favaloro et al. | 343/700 MS |
| 4,242,685 | 12/1980 | Sanford | 343/700 MS |

*Primary Examiner*—Eli Lieberman

*Attorney, Agent, or Firm*—David N. Koffsky

[57] ABSTRACT

A planar antenna is described which employs a pair of closely spaced parallel ground planes and a radiating element which is a composite aperture (hybrid slot) formed into the upper ground plane. One portion of the radiating element is a long narrow slot which may have the shape of a rectangle of high aspect ratio. The other portion is an annular slot which may be circular in shape. Electromagnetic energy is conveyed to and from the slots in the upper ground plane by means of a feed conductor parallel to and sandwiched between the two ground planes. The maximum of the resulting field pattern is in the plane of the antenna and the pattern may be either directional or omnidirectional in that plane. When used as a receiving antenna, this antenna responds to both the electric and magnetic fields.

12 Claims, 7 Drawing Figures

STRIPLINE FED HYBRID SLOT ANTENNA

This invention relates to antennas for radiating and receiving electromagnetic waves. More particularly, it relates to multiport antennas that have several selectable radiation patterns which are substantially constant over a wide band of frequencies.

BACKGROUND OF THE INVENTION

In the inventor's U.S. Pat. No. 3,710,340 there is described a quasi-planar antenna consisting of two resonant elements of the dual type fed simultaneously from the same transmission line. The resonant elements are adjusted so that the image impedance of the composite two-port structure is nearly constant and resistive over a very wide frequency band. In a given plane, one element (i.e., a monopole) has an omnidirectional pattern and the other (i.e., a slot), a typical figure eight dipole pattern. Proper adjustment of feeder impedance relative to the impedances of the individual elements leads to a undirectional pattern with high front-to-back ratio over the operating band width.

To achieve directionality of transmission in the inventor's previous structure, required that a cavity be emplaced around a slot cut in the ground plane. While operational, this provided a rather unwieldy structure having substantial protrusions on both sides of the ground plane.

Other attempts at constructing planar microwave antennas are illustrated in U.S. Pat. Nos. 3,665,480 and 4,208,660. Both of these patents describe a system wherein an annular opening in a ground plane is fed via a stripline arrangement in such a manner that the propagation pattern from the antenna is orthogonal to the planar dimension of the antenna. In the '480 patent, the frequency of transmission is directly related to the dimension of the annular opening, whereas in the '660 patent a plurality of annular openings are provided so as to enable a multifrequency transmission. Neither of these structures provide a planar antenna wherein the pattern maximum is in the plane of the antenna and is selectable in azimuth.

Accordingly, it is an object of this invention to provide a substantially planar antenna whose direction of propagation is parallel to and either omni- or multidirectional over the plane of the antenna.

It is another object of this invention to provide a substantially planar antenna whose input impedance is substantially constant and resistive over a wide band of frequencies.

It is a further object of this invention to provide a substantially planar antenna, which in the receiving mode responds to both electric and magnetic fields.

SUMMARY OF THE INVENTION

The antenna of the present invention achieves the above objectives by employing a pair of closely spaced parallel ground planes and a radiating element which is a composite aperture (hybrid slot) cut into the upper ground plane. One portion of the radiating element is a long narrow slot which may have the shape of a rectangle of high aspect ratio. The other element is an annular slot which may, for example, be circular in shape. Electromagnetic energy is conveyed to and from the slots in the upper ground plane by means of a feed conductor parallel to and sandwiched between two ground planes.

The linear slot portion of the hybrid slot, acting by itself, presents a discontinuity to the feed conductor which can be modeled approximately as a lossy resonant element of the shorted stub type in series with the feed line. The annular slot acting by itself presents a discontinuity which can be modeled approximately as a lossy resonant element of the open stub type in shunt with the feed line. By adjusting the geometric parameters of these two radiating elements, the frequencies of the two resonances can be made to very nearly coincide, and, consequently, the impedance of the hybrid slot remains substantially constant and resistive over a wide band of frequencies.

If the minimum profile version of the antenna is not required, the annular slot may be replaced by a vertical monopole having any of several different shapes. The low profile feature of this structure can be maintained even with a monopole element by using top loading or other means to minimize the height of the monopole.

The invention will be better understood from the following detailed description thereof taken in conjunction with the accompanying drawings, in which.

Figure 1:
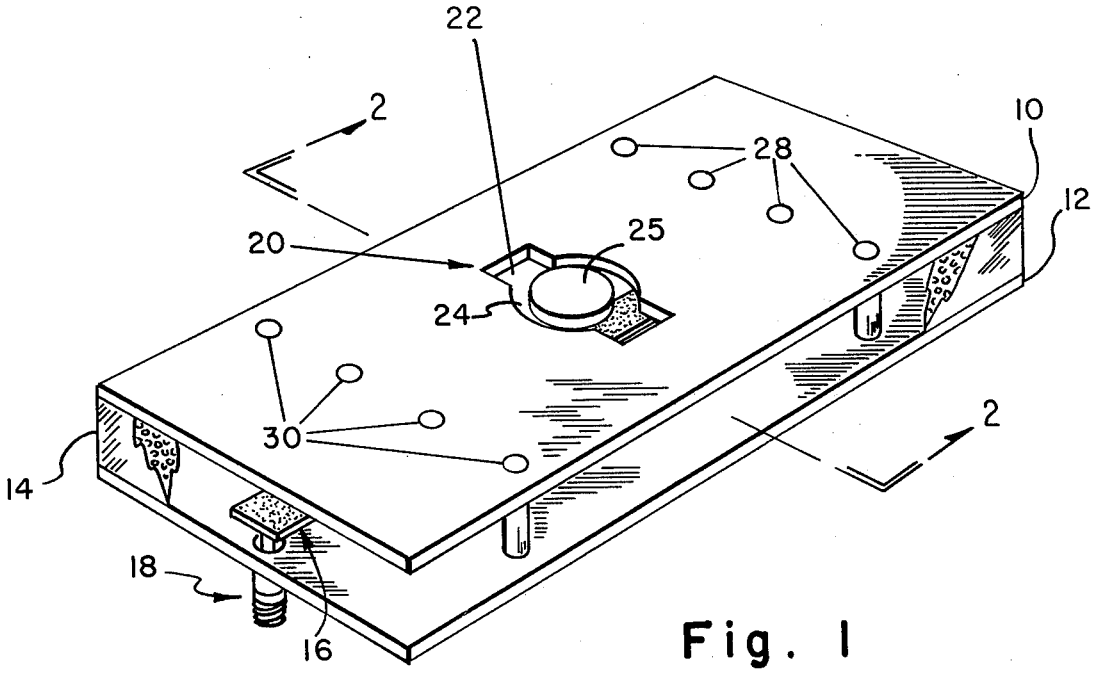
FIG. 1 is a perspective view of a two-port hybrid slot configuration of this invention.
Figure 2:
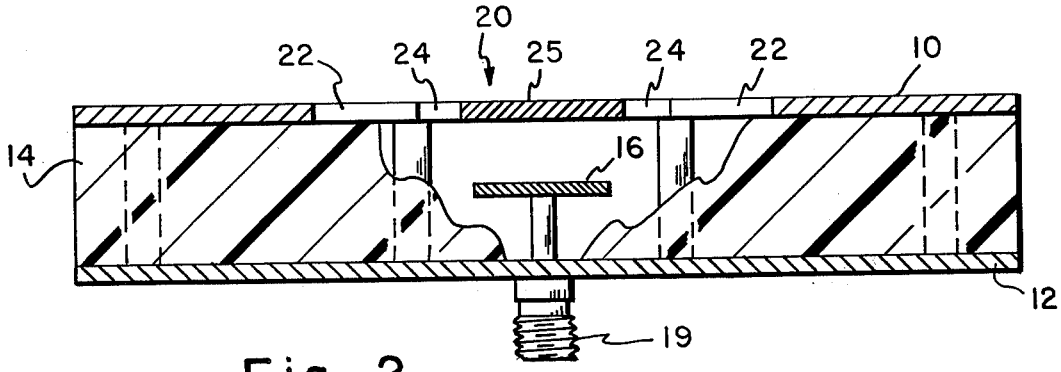
FIG. 2 is a cross section of the antenna of FIG. 1 taken along lines 2—2.
Figure 2A:
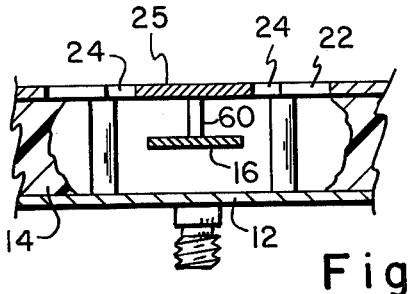
Figure 2B:
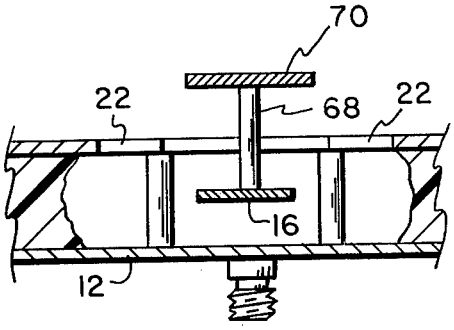
Figure 5:
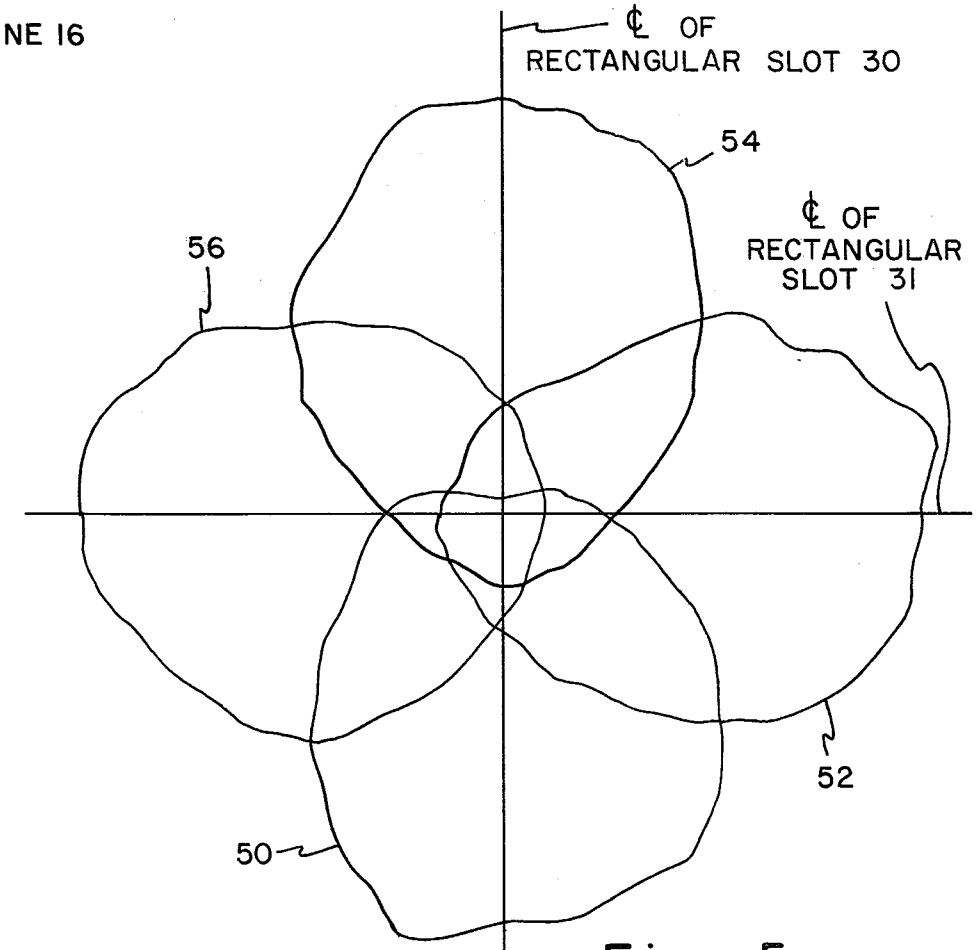
Figure 3:
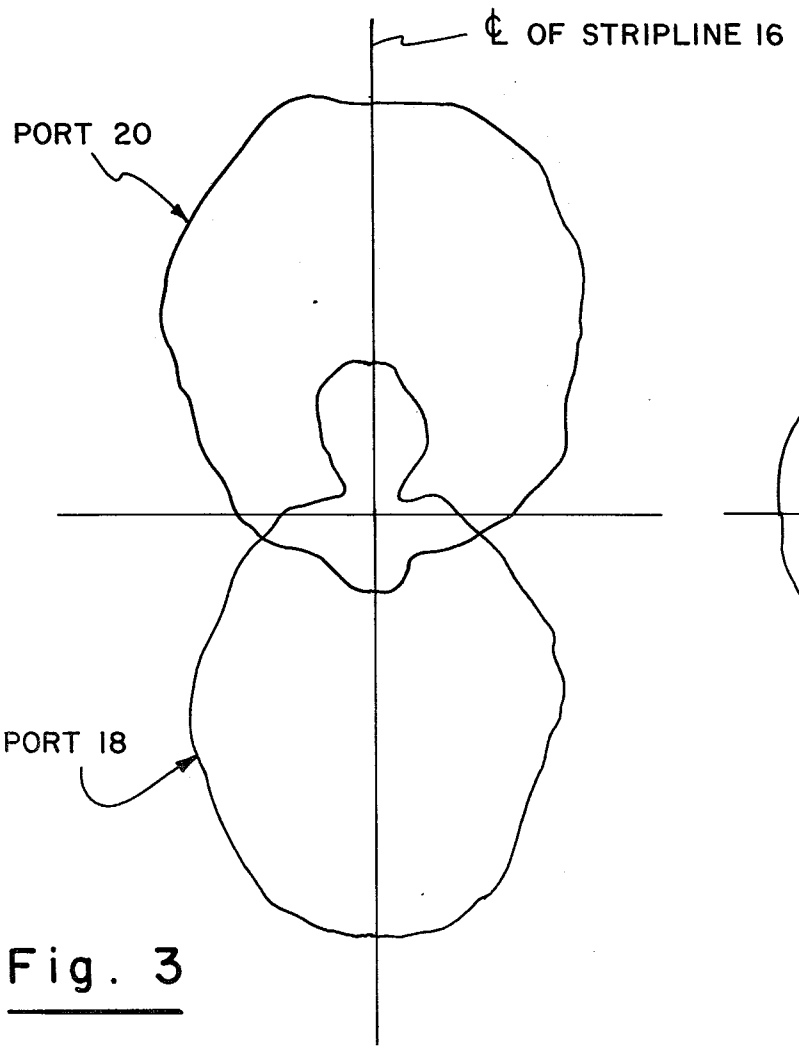
Figure 4:
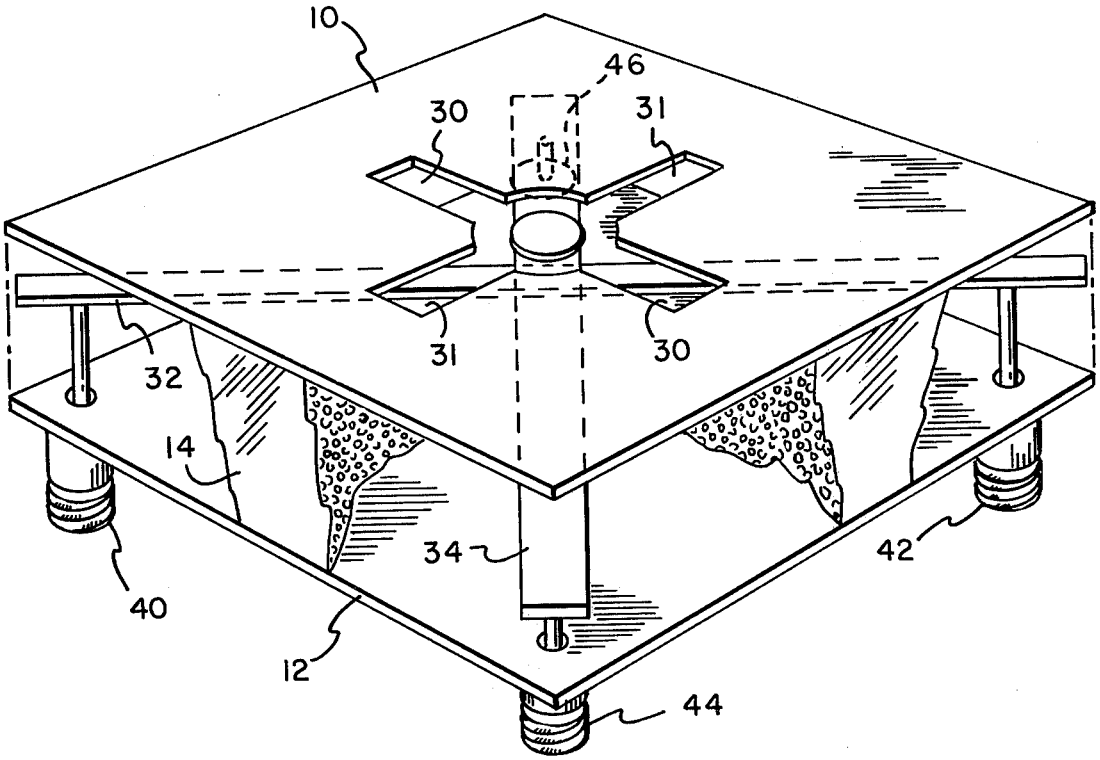

FIG. 2*a* is a cross-section of a modification of the antenna of FIG. 1;

FIG. 2*b* is a cross-section of still another modification of the antenna shown in FIG. 1;

FIG. 3 is a polar plot of radiation patterns associated with each of the ports of the two-port hybrid slot antenna;

FIG. 4 is a perspective view of a four-port hybrid slot antenna of this invention; and FIG. 5 is a polar plot of radiation patterns of a four-port hybrid slot antenna.

DETAILED DESCRIPTION OF INVENTION

Referring now to FIGS. 1 and 2, the antenna of this invention is comprised of two parallel conducting ground planes 10 and 12, that are held in position by dielectric material 14 which fills all or an appropriate part of the region between the ground planes. The length and width of ground planes 10 and 12 are approximately 1 wavelength or greater and the separation between them is a small fraction of a wavelength. A single conductor shown in the form of a stripline 16 runs parallel to and between ground planes 10 and 12, and is likewise supported by dielectric 14. At each end of stripline 16 are input transducers 18 and 19 which connect stripline 16 to external transmission means.

A hybrid slot 20 composed of two portions 22 and 24 is formed into the upper ground plane 10. Aperture portion 22 is rectangular in shape and can be considered to be the outer extremities of a thin rectangular slot. Inner portion 24 is circular in shape and can be considered to be an annular slot. A conducting patch 25 remains after formation of the annular slot 24. Conducting posts 28 and 30 connect the upper and lower ground planes 10 and 12 in such a manner as to form a cavity with vertical walls that surround hybrid slot 20, but permit passage of stripline 16.

A planar antenna of the configuration shown in FIG. 1 was constructed having a hybrid slot 20 with the following dimensions: radius of annular slot, 24=0.7 inches, radius of circular patch 25=0.65 inches, and, overall length of rectangular slot 22, 5.2 inches. Stripline 16 was energized via input feed 18 by a microwave generator whose frequency varied from 700 Mhz to 1.36 Ghz. Output port 19 was terminated with a matched load. A voltage standing wave ratio of less than 2 over most of the band was measured. In addition, in the band between 1.325 and 1.345 Ghz, less than 10 percent of the incident power was dissipated in the matched load.

The horizontal planar pattern of the annular slot 24, taken alone, is like that of an electric dipole perpendicular to the ground plane. However, the pattern of the linear rectangular slot 22 in the same plane has a figure eight shape with 180° phase difference between the two lobes. When these two patterns are combined with the appropriate amplitude and phase relationship, the resulting pattern will be a cardioid as shown in FIG. 3. By feeding port 18, the cardioid maximum occurs in the direction of that port. Hence, feeding port 19 will reverse the direction of the beam. By feeding both ports 18 and 19 in phase, the linear slot fields cancel and the annular slot pattern alone is obtained (omni-directional). By feeding both ports 180° out of phase, the annular slot fields cancel and the linear slot pattern alone is obtained (figure eight shaped).

In the receiving mode, the hybrid slot can be analyzed as a combined linear slot in the horizontal plane and a monopole (electically nearly equivalent to the annular slot) in the vertical plane. The vertical monopole produces a signal at the output port which is proportional to the incident vertical electrical field at the monopole location. The horizontal linear slot produces a signal at the output port which is proportional to the incident horizontal magnetic field. In a cluttered urban environment, scattering of transmitted waves from tall structures produce wave interference patterns in space wherein the electric or magnetic field may be zero at a given location. Conventional antennas used in mobile communication services, such as whips, respond only to the electric field and are therefore subject to fading whenever a null region of the electric field is encountered. Such is not the case with the hybrid slot since it will respond to the magnetic field in those regions. Tests have shown that variation in signal level greater than 12 db may be observed in a whip antenna as a standing wave field is moved across the antenna. The variation in level of a received signal for a hybrid slot under similar circumstances is less than 4.5 db.

To improve the coverage of the radiation pattern of the hybrid slot antenna, a second linear slot which is orthogonal to the first can be added as shown in FIG. 4. In FIG. 4, ground planes 10, 12 and dielectric 14 correspond to those shown in FIG. 1. However, the hybrid slot is now provided with four rectangular positions 30 and 31. In order to feed this aperture arrangement, two striplines, 32 and 34, are provided at right angles to each other, each making an angle of 45° with respect to the axis of rectangular slots 30. Striplines 34 and 32 are offset from each other in the vertical plane and are separated by insulating material 14 at the crossover. (There is no conductive connection between them.) Transducers 40 and 42 feed either extremity of stripline 32, whereas transducers 44 and 46 feed stripline 34.

The radiation pattern for the antenna for FIG. 4 is shown in FIG. 5. When input transducers 44 and 42 are fed in-phase, the pattern is a cardioid 50. Similar cardioid patterns 52, 54, and 56 (which are rotated sequentially by 90 degrees in azimuth) are obtained by feeding in-phase, input transducers 42 and 46; 46 and 40; and 40 and 44, respectively. An omnidirectional pattern can be obtained by feeding all ports, in phase, simultaneously.

Several modifications of the above structures can be contemplated. Referring to FIG. 2*a*, to improve impedance coupling, center conductor 25 of the annular slot can be interconnected by a conductor 60 to stripline 16. This will provide some improved impedance matching, but is not absolutely necessary.

A similar conducting post (not shown) connected to the underside of conducting patch 25 can be employed in the antenna of FIG. 4; however, it should not contact either of striplines 34 or 32. The conducting post is adjusted to control coupling between those striplines and the annular slot for improved operation.

Referring to FIG. 2*b*, circular patch 25 of the annular slot has been replaced by a vertical monopole. The low profile feature of the structure can be maintained even with a monopole element by using top load 70 or other means to minimize the height of the monopole.

Several forms of the antenna have been constructed from dielectric substrate boards 3/16th inch in thickness having a relative permittivity of 2.6 with thin copper cladding on one side. The feed conductor was copper tape with adhesive backing. Commercially available transducers from stripline to type N coaxial connectors were secured to the lower ground plane substrate pair, and the center pin of the transducer was soldered to the copper tape. The copper cladding was cut away from the upper ground plane to form the slot/aperture. The rectangular portion of the slot was ¼ inch in width and 6.0 inches in length. Variations in resonant frequency of the rectangular slot were achieved by reducing the length of the slot with copper tape. The inner and outer radii of the annular slot were varied between 0.5 inches and 1.0 inches in the course of experiments with the antenna. A cavity was formed around the slots by placing conducting machine screws through both ground planes and the intervening dielectric. By this means, the upper and lower ground planes were electrically connected at points which were periodically spaced along a rectangle 3 inches by 7 inches in dimension. Scattering parameters and radiation patterns were measured over an extended frequency band around 1.3 Ghz.

I claim:

1. A substantially planar antenna structure comprising:

a pair of parallel conducting ground planes;

a hybrid aperture formed into the uppermost of said ground planes, said aperture including elongated outer sections which are sustantially rectangular in shape, and an inner substantially circular section, the interior of said circular section containing a conductive portion concentric with said circular section;

a first linear conductor disposed between and parallel to said ground planes, the length of said linear conductor spanning said entire hybrid aperture; and means for feeding a radio frequency signal to or from said linear conductor.

2. The invention of claim 1 wherein said ground planes and linear conductor are supported by dielectric material which fills the region between said ground planes.

3. The invention as defined in claim 2 wherein said linear conductor is provided with ports at its either end.

4. The invention as defined in claim 3 wherein said linear conductor is perpendicular to the elongated dimension of said outer sections.

5. The invention as defined in claim 4 further including means connecting said pair of ground planes at a plurality of points around said hybrid aperture, to create a cavity surrounding said hybrid aperture.

6. The invention as defined in claim 4 wherein said inner section is electrically connected to said linear conductor.

7. The invention as defined in claim 1 wherein said hybrid aperture includes four outer rectangular sections which are orthogonally arranged around said inner section, and a second linear conductor disposed between said first linear conductor and one of the ground planes and arranged orthogonally to said first linear conductor; and means for applying a signal source to said second linear conductor.

8. The invention as defined in claim 6 wherein said first and second linear conductors are arranged so that they are rotated by 45° from the arrangement of said rectangular outer sections.

9. A substantially planar antenna structure comprising:

a pair of parallel conducting ground planes;

an aperture formed into the uppermost of said ground planes, said aperture including elongated outer sections which are substantially rectangular in shape, and an inner substantially circular section;

a first linear conductor disposed between and parallel to said ground planes, the length of said linear conductor spanning said entire aperture;

monopolar antenna means extending from said linear conductor, through said aperture and above said uppermost ground plane, and means for feeding a radio frequency signal to or from said linear conductor.

10. An antenna structure comprising:

a pair of parallel conducting ground planes;

elongated aperture means formed into the uppermost of said ground planes and having both long and narrow dimensions and including an enlarged portion surrounding an isolated section of ground plane;

a linear conductor disposed between and parallel to said ground planes and oriented orthogonally with respect to the long dimension of said elongated aperture means, the length of said linear conductor spanning the narrow dimension of said aperture means; and means for feeding a radio frequency signal to or from said linear conductor.

11. The invention of claim 10 wherein said isolated section of ground plane is electrically connected to said linear conductor.

12. An antenna structure comprising:

a pair of parallel conducting ground planes;

elongated aperture means formed into the uppermost of said ground planes and having both long and narrow dimensions;

a linear conductor disposed between and parallel to said ground planes and oriented orthogonally with respect to the long dimension of said elongated aperture means, the length of said linear conductor spanning the narrow dimension of said aperture means;

monopolar antenna means extending from said linear conductor through said elongated aperture means and above said uppermost ground plane; and means for feeding a radio frequency signal to or from said linear conductor.

* * * * *